US007815075B2

(12) United States Patent
Simkins

(10) Patent No.: US 7,815,075 B2
(45) Date of Patent: Oct. 19, 2010

(54) PERSONAL SQUEEZE BOTTLE DISPENSER

(75) Inventor: Nelson E. Simkins, Rittman, OH (US)

(73) Assignee: Joseph S Kanfer, Richfield, OH (US)

( * ) Notice: Subject to any disclaimer, the term of this patent is extended or adjusted under 35 U.S.C. 154(b) by 1324 days.

(21) Appl. No.: 11/190,262

(22) Filed: Jul. 28, 2005

(65) Prior Publication Data

US 2007/0023453 A1 Feb. 1, 2007

(51) Int. Cl.
*B67D 7/06* (2010.01)

(52) U.S. Cl. ..... 222/183; 222/95; 222/505; 222/509; 222/214; 222/525

(58) Field of Classification Search ..... 222/183, 222/95, 470, 471, 378, 251, 105, 213, 207, 222/599, 518, 505, 522–525, 509, 209, 212, 222/214, 513, 514, 191; 220/4.22, 375, 603, 220/256.1; 215/386
See application file for complete search history.

(56) References Cited

U.S. PATENT DOCUMENTS

| | | | | |
|---|---|---|---|---|
| 2,090,018 | A * | 8/1937 | Armstrong | 222/326 |
| 2,822,111 | A * | 2/1958 | Tripoli | 222/100 |
| 2,936,006 | A * | 5/1960 | Henley | 222/101 |
| 3,310,830 | A * | 3/1967 | Gattone | 401/190 |
| 3,946,904 | A * | 3/1976 | Mulakala | 222/102 |
| 4,651,905 | A * | 3/1987 | Hayes | 222/394 |
| 5,230,447 | A * | 7/1993 | Kirk | 222/505 |
| 5,417,336 | A * | 5/1995 | Cortez | 215/386 |
| 6,199,726 | B1 * | 3/2001 | Cardwell et al. | 222/402.11 |
| 7,044,137 | B2 * | 5/2006 | Glucksman et al. | 132/114 |
| 7,121,431 | B2 * | 10/2006 | Duke | 222/183 |
| 2007/0062982 | A1 * | 3/2007 | Blum et al. | 222/518 |

* cited by examiner

*Primary Examiner*—Kevin P Shaver
*Assistant Examiner*—Robert K Nichols, II
(74) *Attorney, Agent, or Firm*—Renner, Kenner, Greive, Bobak, Taylor & Weber

(57) ABSTRACT

A personal squeeze bottle dispenser has a clamshell housing adapted to receive a squeeze bottle having a push/pull dispensing valve. A slide mechanism is received within the housing and has a collar at one end engaging the push/pull valve, and a spring at the other end to effect automatic return of the slide mechanism upon termination of a dispensing cycle. The spring biases the push/pull valve to the closed position. The clamshell housing is configured with an opening for a thumb pad of the slid mechanism to achieve opening of the push/pull valve and accommodating pressure upon the squeeze bottle. An opening on the backside of the housing, opposite the thumb pad, is also provided to allow the user's fingers to access the squeeze bottle for the application of dispensing force.

13 Claims, 2 Drawing Sheets

PERSONAL SQUEEZE BOTTLE DISPENSER

TECHNICAL FIELD

The invention herein resides in the art of dispensers for fluids such as lotions, soaps, sanitizers and the like. More particularly, the invention pertains to personal portable dispensers, sized and configured for ease of use. More specifically, the invention relates to a personal squeeze bottle dispenser having a push/pull cap valve that is biased to the closed position.

BACKGROUND ART

There presently is widespread use of lotions, soaps and sanitizers in various venues. Personal portable bottles are now known, and commonly used by those aware of the need for proper hand hygiene to prevent disease. However, presently known personal portable bottles are generally inconvenient, not given to ease of portability and use. Moreover, presently known personal portable bottles are not reliable as to the closure mechanisms employed and, accordingly, are given to inadvertent opening and dispensing of the liquid contents and/or the dripping of such contents onto clothing, furniture, personal items and like.

There is a need in the art for a personal squeeze bottle dispenser that is convenient and easy to use and reliable and durable in operation so as to encourage the use of appropriate lotions, soaps and sanitizers to effect proper hand hygiene and reduce the transmittal of disease.

DISCLOSURE OF THE INVENTION

In light of the foregoing, it is a first aspect of the invention to provide a personal squeeze bottle dispenser that is both convenient to carry and to use.

Another aspect of the invention is the provision of a personal squeeze bottle dispenser that is not given to inadvertent opening and/or dispensing.

Still a further aspect of the invention is the provision of a personal squeeze bottle dispenser that has positive automatic closure of the dispensing valve, following the release of the force required to open the valve.

Yet a further aspect of the invention is the provision of a personal squeeze bottle dispenser that is amenable to the implementation of replaceable bottles.

Still another aspect of the invention is the provision of a personal squeeze bottle dispenser that employs a single thumb pad to both open and effect dispensing of liquid from the squeeze bottle.

The foregoing and other aspects of the invention that will become apparent as the detailed description proceeds are achieved by a personal fluid dispenser, comprising: a housing defining a cavity; a bottle received within said cavity; a valve received by said bottle for opening and closing said bottle; and an actuator received by said housing and in engagement with said valve, said actuator adapted to be manually manipulated to open and close said valve.

Other aspects of the invention that will become apparent herein are achieved by a personal fluid dispenser, comprising: a housing; a squeeze bottle received by said housing; a push/pull valve received by said bottle for opening and closing said bottle; a slide actuator received by said housing and engaging said push/pull valve; and a return spring connected at a first end to said slide actuator, and at a second end to said housing.

BRIEF DESCRIPTION OF DRAWINGS

For a complete understanding of the objects, techniques and structure of the invention, reference should be made to the following detailed description and accompanying drawings wherein.

DETAILED DESCRIPTION OF PREFERRED EMBODIMENT FOR CARRYING OUT THE INVENTION

Figure 1:
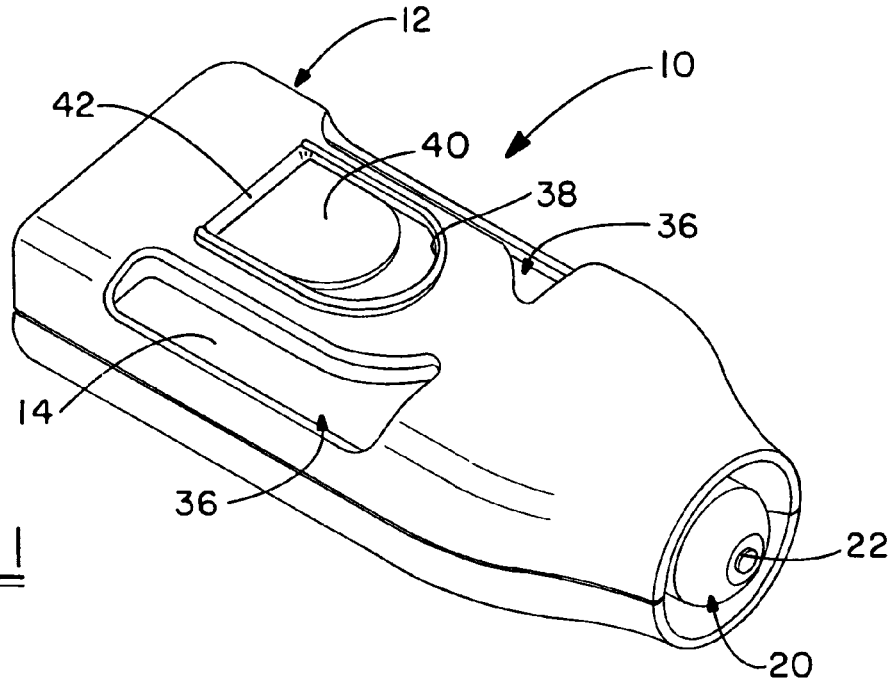
FIG. 1 is a perspective view of the personal squeeze bottle dispenser according to the invention, showing the push/pull valve in the closed transport position.
Figure 2:
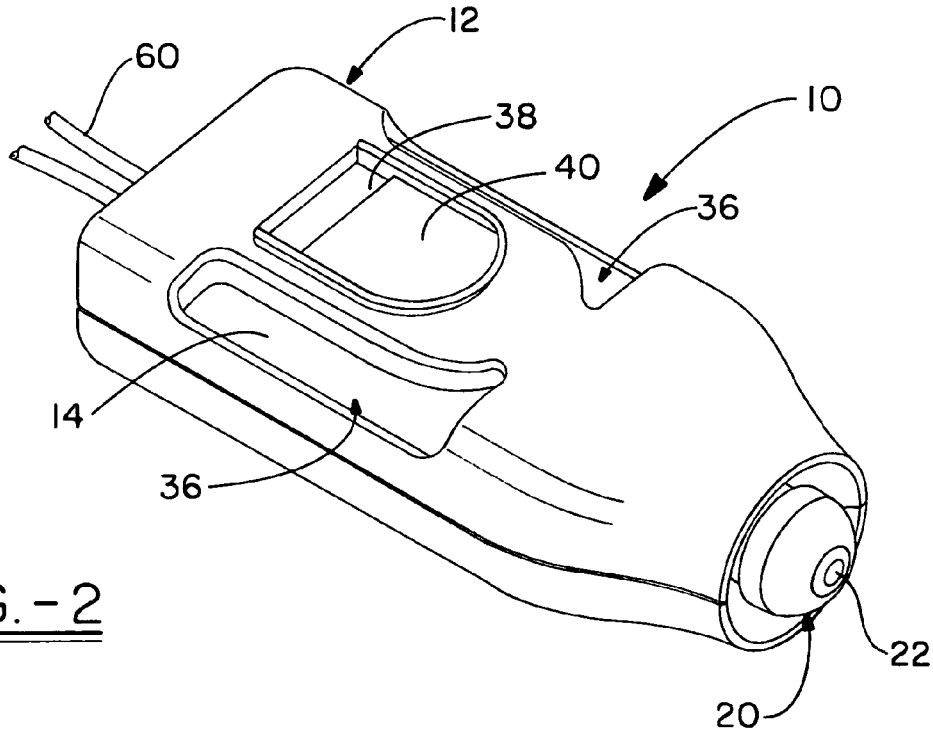
FIG. 2 is a perspective view of the personal squeeze bottle dispenser of FIG. 1, showing the push/pull valve in the dispense position.
Figure 3:
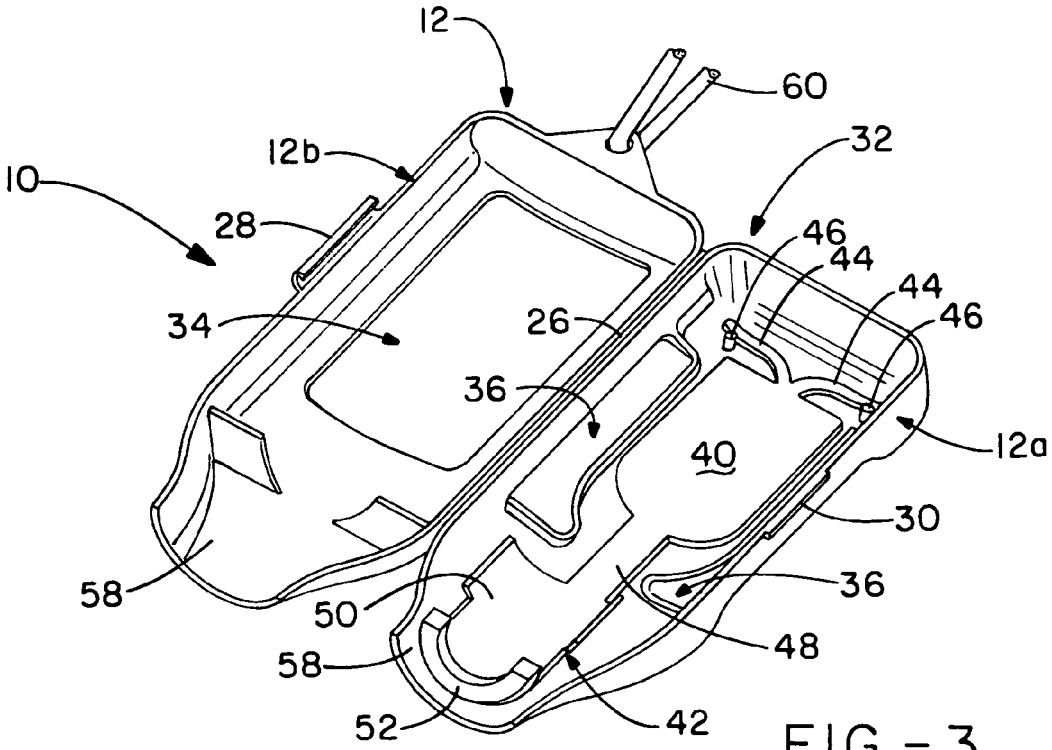
FIG. 3 is a perspective view of the clamshell housing adapted for receiving the squeeze bottle employed in the invention.

Referring now to the drawings, and more particularly FIGS. 1-3, it can be seen that a personal squeeze bottle dispenser made in accordance with the invention is designated generally by the numeral 10. The dispenser 10 includes a housing 12 adapted to nestingly receive a bottle or other suitable container 14 therein. As will become apparent later, the bottle 14 is preferably a squeeze bottle, of the type allowing dispensing of the fluid contained therein by squeezing and collapsing of the bottle itself. The bottle 14 has a threaded neck 16 adapted to threadingly receive a cap 18, which secures an appropriate push/pull valve 20 within the neck 16. Those skilled in the art will readily appreciate the structure and function of the push/pull valve 20, which in the retracted position closes the bottle 14 and prevents the dispensing of the contents, while in the extended position accommodates opening of the bottle to accomodate such dispensing.

The push/pull valve 20 is characterized by an aperture 22 in an end thereof, communicating through an axial passage 24 with the interior of the bottle 14. It is through the axial passage 24 and the aperture 22 that liquid is dispensed from the bottle 14 when the valve 20 is in the extended open position. It will be readily appreciated that FIG. 1 shows the push/pull valve 20 in the retracted closed position, as does FIG. 4 in the solid line depiction of the valve 20. The extended open position of the valve 20 is illustrated in FIG. 2 and in the phantom depiction of the valve 20 in FIG. 4. As is well known in the art of push/pull valves, the push/pull valve 20 is moved axially, relative to the axial passage 24, between the retracted and extended positions.

With reference now to FIG. 3, an understanding of the structure of the housing 12 and an associated slide actuating member can be obtained. As shown, the housing 12 is of a clamshell design, having substantially similar sides 12*a* and 12*b*, interconnected by means of an appropriate hinge, such as the living hinge 26. In its preferred embodiment, the living hinge 26 simply comprises a thin film of the material from which the halves 12*a* and 12*b* are molded. Of course, any suitable hinge may be employed. A latch 28 is provided on one of the halves, while a catch 30 is provided on the other, the interpositioning of the latch and catch being a matter of designer's choice.

The halves 12*a*, 12*b* of the clamshell housing 12 define a cavity 32 configured to nestingly receive the bottle assembly 14-24, presented above. The housing half 12*b* is provided with a rear window 34, which provides ready access to a surface of the bottle 14. Side windows 36 are provided on the housing half 12*a* to provide reduced access to a surface of the bottle 14 from a top side of the dispenser 10. The windows 34, 36 allow the user to view the state of the contents of the bottle 14, as to whether it is nearly empty and ready to be replaced. Additionally, the rear window 34 provides an area for access of the fingers of the user to compress the squeeze bottle 14 to achieve dispensing when desired. Similarly, the side windows 14 in the housing half 12*a* accommodate flexure of the housing on the top surface to effect squeezing of the bottle 14 to effect dispensing, as desired.

As further shown in FIGS. 1-3, a window or opening 38 is provided in the top housing 12*a* to expose a thumb pad 40 of a slide assembly 42 received by the housing half 12*a*. As shown, the slide 42 has a pair of spring arms 44 at a back end thereof, which are restricted by means of pins 46, which either abut the spring arms 44, as shown, or actually pass through the ends thereof for fixed pinning engagement. The window 38 is sized and configured to accommodate sufficient movement of the thumb pad 40 to effect full opening and complete closing of the push/pull valve 20 during operation, as will be apparent herein.

Figure 4:
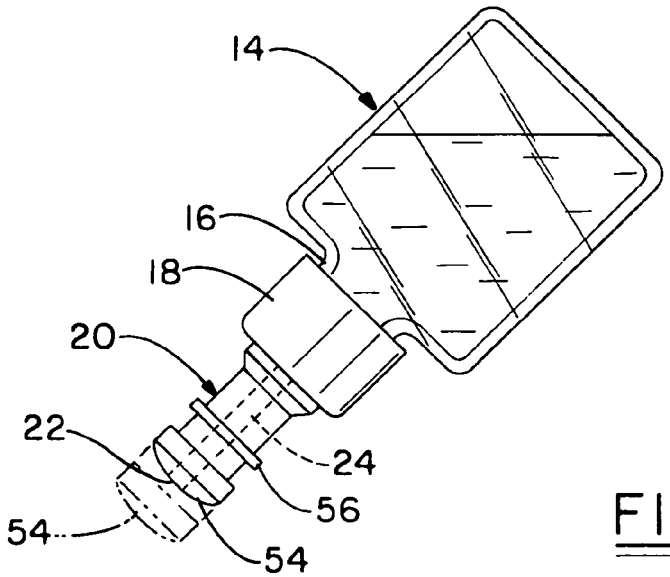
FIG. 4 is a perspective view of the squeeze bottle of the invention, showing the push/pull valve in both the transport and dispense positions.

The slide 42 is further characterized by the neck 48 extending from the thumb pad portion 40 to a collar 50 at an end thereof opposite the end having the spring arms 44. The collar 50 is configured to receive the push/pull valve 20 as illustrated in FIG. 4. The collar 50 is provided with a rim 52 that is sized to be received about the shaft of the valve 20 between the head 54 and the intermediate flange 56 thereof. The slide assembly 42 is adapted for reciprocating movement longitudinally of the housing 12 by the application of thumb force of the user upon the thumb pad 40. Forward movement of the slide 42 causes the collar 50 to extend the push/pull valve 20 to the open position to allow dispensing, while removal of such force allows the spring arms 44 to retract the slide assembly and, accordingly, the push/pull valve 20 to the closed position, such that the valve 20 is normally biased to the closed position.

The housing 12 is provided with a neck 58 through which the collar 50, mated with the push/pull valve 20 is capable of reciprocating movement.

Also provided as part and parcel of the dispenser 10 is a strap or other appropriate connector or carrier 60 to accommodate personal use. A strap 60 may be employed to be received over a belt or through a belt loop, while a clip or other appropriate connector may also be employed. Accordingly, the personal dispenser 10 may be readily available at all times for use, as desired.

It will be appreciated that in the preferred embodiment the bottle 14 is preferably molded of a recoverable plastic material, such that the bottle may be squeezed to dispense fluid contained therein, and recover to its normal configuration after the squeezing force is removed. The invention further contemplates that the housing 12 may be of similar flexible plastic material, so that the housing 12 may itself be flexed or pressed to effect squeezing of the bottle 14. However, it is also contemplated that the housing 12 may be of a more substantial structure, of a more rigid plastic material, so as not to be deflectable. In such a case, squeezing of the bottle 14 will be effected by application of thumb force downwardly on the thumb pad 40, or a finger force upwardly through the window 34.

It is preferred that the slide mechanism 42, including the spring arms 44, be integrally molded of a suitable plastic material to allow for extension and recovery of the spring arms 44 and flexure of the thumb pad 40 to achieve the desired dispensing. Of course, other suitable spring or return mechanisms might be employed, and are contemplated as a portion of the instant invention. Indeed, a spring may be provided apart from the slide mechanism 14, or may be interposed forwardly of the thumb pad 40, rather than in the aft position as shown.

It will be readily appreciated that the bottle 14 is sized and configured to be received within the cavity 32 of the clamshell housing 12. The bottle 14 and associated push/pull valve assembly 20 are simply placed into the cavity, with the area between the head 54 and flange 56 of the valve 20 receiving the rim 52 of the collar 50 of the slide assembly 42. The two clamshell halves 12*a*, 12*b* may then be closed to effect secured engagement of the latch and catch assembly 28, 30 to complete the dispenser assembly.

It should be readily appreciated by those skilled in the art that the spring arms 44 bias the push/pull valve 20 to its closed position such that when the thumb pad 40 is released, the arms 44 pull the slide assembly 42 back, retracting the push/pull valve 20 to close and seal the bottle 14 so that no inadvertent dispensing or dripping of the fluid of the bottle 14 will be encountered.

Accordingly, there has been presented a simple and effective personal squeeze bottle dispenser that may be readily available and constantly maintained in an inverted position, but will not drip, because of continued automatic biasing of the dispensing valve to the closed position. The unit is further capable of ease of use with one hand, that hand effecting not only opening of the push/pull valve 20, but also effecting squeezing of the bottle 14 to achieve such dispensing.

Thus it can be seen that the objects of the invention have been satisfied by the structure presented above. While in accordance with the patent statutes only the best mode and preferred embodiment of the invention has been presented and described in detail, the invention is not limited thereto or thereby. Accordingly, for an appreciation of the true scope and breadth of the invention reference should be made to the following claims.

What is claimed is:

1. A personal fluid dispenser, comprising:

a housing defining a cavity and having a first window;

a bottle received within said cavity and having liquid contents therein;

a push/pull valve received by said bottle for opening and closing said bottle, said push/pull valve being selectively moved between a retracted position in which said bottle is closed and an extended position in which said bottle is open, said push/pull valve being selectively moved in the same direction as an axial passage communicating with the liquid contents of said bottle; and a slide actuator received by said housing, said slide actuator including a thumb pad exposed through said first window of said housing and a collar at a first end of said slide actuator in engagement with said push/pull valve and a second end that is spring biased, said slide actuator adapted to be manually manipulated to move said push/pull valve axially between said retracted and said extended positions, said spring bias serving to pull said push/pull valve to the closed position.

2. The personal fluid dispenser according to claim 1, wherein said first window is sized to accommodate movement of said thumb pad between open and closed positions of said push/pull valve.

3. The personal fluid dispenser as recited in claim 1, wherein said spring bias is effected by a return spring that is integral with said slide actuator.

4. The personal fluid dispenser as recited in claim 2, wherein said housing has a second window on a side opposite a side having said first window, said second window exposing said bottle for finger pressure there against.

5. The personal fluid dispenser as recited in claim 4, wherein said housing is a clamshell housing.

6. The personal fluid dispenser as recited in claim 5, wherein said housing has a carrier attached thereto.

7. The personal fluid dispenser as recited in claim 4, wherein said thumb pad is deflectable against said bottle to accommodate the application of dispensing pressure against said bottle.

8. A personal fluid dispenser comprising:

a housing defining a cavity, said housing including a first window and a second window;

a squeeze bottle including a valve for opening and closing said squeeze bottle, said squeeze bottle and said valve received within said cavity;

an actuator received by said housing and in engagement with said valve, said actuator adapted to be manually manipulated to open and close said valve, wherein said actuator is manipulated at said first window and said second window exposes at least a portion of said squeeze bottle for finger pressure thereagainst, such that, when said valve is open, said finger pressure is suitable for dispensing contents of said squeeze bottle.

9. The personal fluid dispenser according to claim 8, wherein said bottle is made of substantially flexible material.

10. The personal fluid dispenser according to claim 9, wherein said housing is substantially rigid.

11. The personal fluid dispenser according to claim 9, wherein said housing is substantially flexible, accommodating squeezing deflection of said bottle.

12. The personal fluid dispenser according to claim 9, wherein said housing further comprises a carrier attached to said housing, said carrier adapted to accommodate carriage of said housing and bottle by an individual.

13. A personal fluid dispenser comprising:

a housing defining a cavity, said housing including a first window and a second window;

a squeeze bottle made of substantially flexible material and received within said cavity;

a valve received by said squeeze bottle for opening and closing said squeeze bottle; and an actuator received by said housing and in engagement with said valve, said actuator adapted to be manually manipulated to open and close said valve, wherein said actuator is manipulated at said first window and said second window exposes at least a portion of said squeeze bottle for finger pressure thereagainst, such that, when said valve is open, said finger pressure is suitable for dispensing contents of said squeeze bottle, wherein said housing is a clamshell housing having a hinge along one side thereof and a catch and latch assembly along an opposite side thereof.

* * * * *